United States Patent [19]

Culbertson et al.

[11] Patent Number: 4,537,357

[45] Date of Patent: Aug. 27, 1985

[54] SPRAY GUNS

[75] Inventors: Samuel W. Culbertson, Arvada, Colo.; George Dixon, West Midlands, England

[73] Assignee: Binks Manufacturing Company, Franklin Park, Ill.

[21] Appl. No.: 658,209

[22] Filed: Oct. 5, 1984

Related U.S. Application Data

[63] Continuation-in-part of Ser. No. 374,257, May 3, 1982, abandoned.

[51] Int. Cl.[3] ..... B05B 1/28

[52] U.S. Cl. ..... 239/290; 239/600

[58] Field of Search ..... 239/290, 296, 297, 298, 239/299, 300

[56] References Cited

U.S. PATENT DOCUMENTS 2,112,546 10/1928 Smart ..... 239/300
2,139,133 12/1938 Paasche ..... 239/298
2,626,188 1/1953 Dalrymple ..... 239/290
4,392,617 7/1983 Bakos et al. ..... 239/290

*Primary Examiner*—Andres Kashnikow
*Assistant Examiner*—Scott D. Malpede
*Attorney, Agent, or Firm*—Gary, Juettner & Pyle

[57] ABSTRACT

Improved spray guns each have a spray head assembly comprising separate but interconnectable elements including a fluid nozzle, a fluid inlet fitting, a fluid nozzle retainer, an air nozzle and an air cap. The elements mount on an annular extension at a forward end of the gun body without any threaded attachment to the body, and because they are separate the fluid nozzle and fluid inlet fitting may conveniently be manufactured of a corrosion and wear resistant material to protect the same from fluid flowing therethrough. Also, the air cap threads onto the fluid nozzle retainer and not the gun body, so there is no danger of damaging any threads on the body which could otherwise require its replacement.

19 Claims, 5 Drawing Figures

20
22
40
42
44
100
102
50
46
28
36
30
48
34
32
38
24
26

SPRAY GUNS

BACKGROUND OF THE INVENTION

This application is a continuation-in-part of application Ser. No. 374,257, filed May 3, 1982 and now abandoned.

The present invention relates to spray guns in general, and in particular to improved spray guns having a spray head assembly comprising separate but interconnectable elements mounted on a foward end of the gun body without threaded attachment to the body.

Fluid passages through the head of a spray gun are desirably of a corrosion and wear resistant material for protection against various types of coating mterials. Prior approaches to corrosion and wear protection usually contemplated either use of a separate and removable corrosion resistant head casting or threading a stainless steel insert and a stainless steel fluid inlet insert into the gun head at right angles to each other, machining the inserts while in place to form fluid passages and then securing them in position with epoxy. A problem encountered in the former approach is that a compromise occurs in weight and balance considerations that are important to the "feel" of a spray gun, and in the latter loosening of the epoxy often occurs when a gun is soaked in solvent for an extended period. In addition, threads for receiving an air cap for mounting an air nozzle on the head of the gun are usually formed on the gun body, which arrangement presents difficulties in that the threads are susceptible to damage, and if damaged the gun body, which is essentially the entire gun, is ruined and requires replacement.

In improving upon prior spray guns, in the guns of the invention the spray head assemblies are comprised of separate but interconnectable elements including a fluid nozzle, a fluid inlet fitting, a fluid nozzle retainer, an air nozzle and an air cap. Since the elements are separate from the body, the fluid inlet fitting and fluid nozzle may conveniently be manufactured from a corrosion and wear resistant material, and the arrangement of the components offers significant improvements in weight, feel, maintenance and reliability. The components may readily be assembled on the forward end of the gun without need for any machining or compromises in the "feel" of the gun, and the fluid nozzle retainer itself, not the gun body, has threads for receiving the air cap for mounting the air nozzle on the gun. Consequently, should the threads be damaged, only the fluid nozzle retainer, and not the substantial entirety of the gun, needs to be replaced.

The foregoing and other objects, advantages and features of the invention will become apparent upon a consideration of the following detailed description, when taken in conjunction with the accompanying drawings.

DETAILED DESCRIPTION

Figure 1:
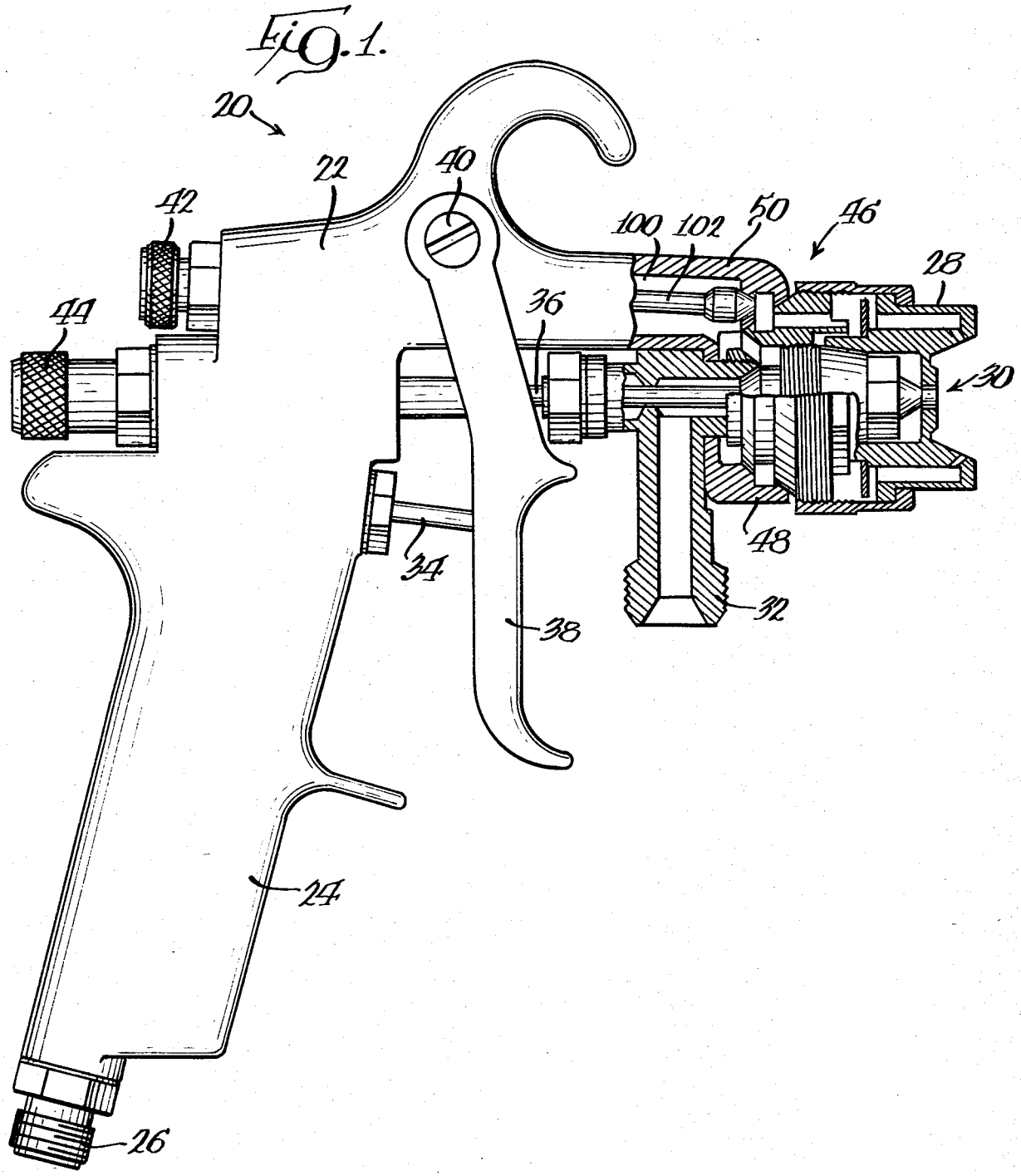
FIG. 1 is a side elevation view, partly in cross section, illustrating an air spray gun having an improved spray head assembly in accordance with one embodiment of the present invention.

Referring to FIG. 1 a spray gun assembly, indicated generally at 20, includes a spray gun 22 having a handle 24 adapted for connection at its lower end with a source of compressed air through a fitting 26. The gun has an air nozzle 28 and fluid nozzle means, indicated generally at 30, through which fluid provided to the gun through an inlet fitting 32 is disposed for being atomized into a spray and formed into a fan-shaped pattern by jets of air emitted from the air nozzle. To control the spraying operation an air valve means 34 is movable between open and closed positions to control a flow of pressurized air through the gun, a fluid valve stem 36 is movable between open and closed positions to control a flow of fluid through the fluid nozzle means and a manually manipulatable trigger 38 is operably connected with the valve means and stem. The trigger is mounted at an upper end by a pivot pin 40 and is manually movable between a gun off position away from the handle whereat the air valve means and fluid valve are closed, to a gun on position toward the handle whereat the air valve means and fluid valve are open and a spray of material is emitted. Adjustment of an air control knob 42 determines the amount of atomizing air emitted when the gun is on and adjustment of a fluid control knob 44 determines the dispensing rate of material.

To the extent described the spray gun assembly is known in the art and, if conventional and having corrosion and wear resistant fluid passageways, would ordinarily be provided either with a corrosion and wear resistant spray head casting or a stainless steel fluid inlet and outlet inserts threaded into the head of the gun at right angles to each other, machined while in the gun to form the fluid passage and secured in place by epoxy. However, since the gun body is usually aluminum so that it might have a light weight for operator comfort, a problem encountered in the former approach is that a compromise occurs in the weight and balance considerations that are important to the "feel" of the gun, and in the latter loosening of the epoxy often occurs when the gun is soaked in solvent for an extended period of time. Also, with conventional guns the threads for receiving an air cap for mounting an air nozzle are usually formed on the aluminum gun body, which presents difficulties in that aluminum threads are relatively susceptible to damage, and if damaged then the entire gun body is ruined.

In improving upon prior spray guns, according to the invention the spray head assembly comprises separate but interconnectable elements including a fluid nozzle, a fluid nozzle retainer and a fluid inlet fitting, which because they are separate enable the fluid nozzle and fluid inlet fitting to conveniently be manufactured out of a corrosion and wear resistant material. The elements may readily be mounted on the forward end of the gun body without threaded attachment to the body, and provide leakproof fluid passages without need for any separate machining or compromises in the "feel" of the gun. At the same time, the fluid nozzle retainer itself, not the gun body, has threads for mounting an air cap, so that should the threads be damaged only the nozzle retainer needs replacement and not the substantial entirety of the spray gun.

Figure 2:
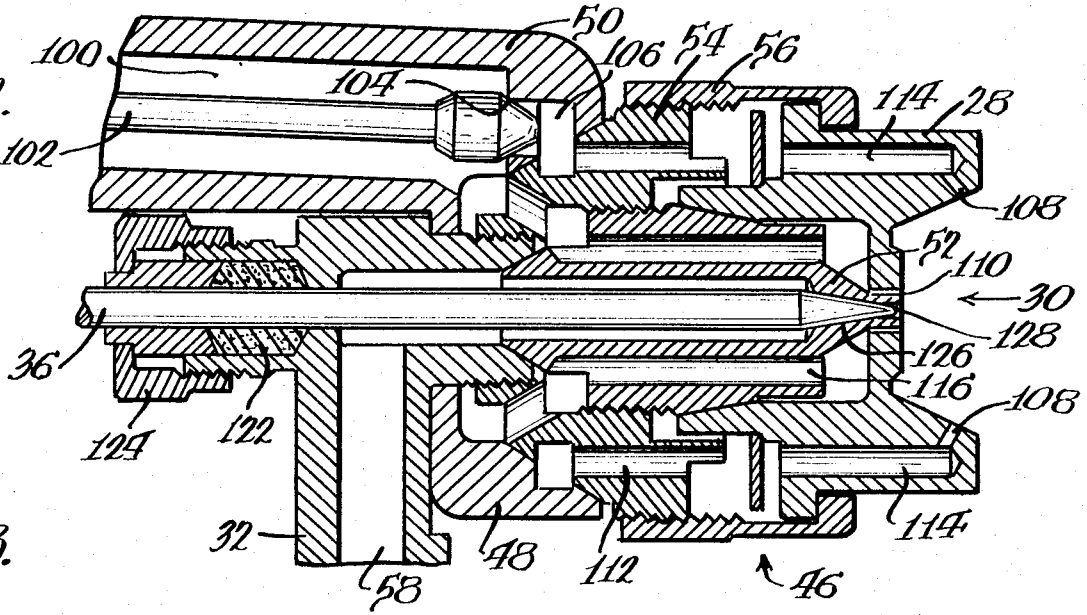
FIG. 2 is an exploded cross sectional view of the spray head assembly shown in FIG. 1.
Figure 3:
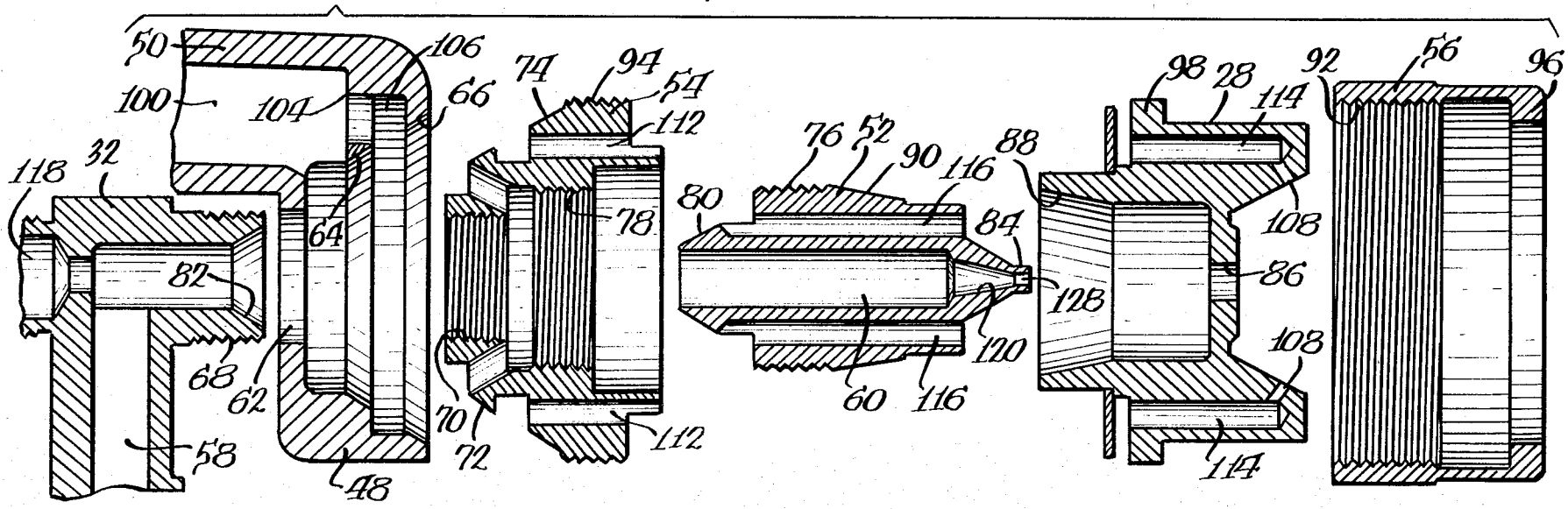
FIG. 3 is a cross sectional assembly view of the spray head assembly of FIG. 2.

Referring also to FIGS. 2 and 3, an improved spray head assembly, indicated generally at 46, is mounted on a downwardly depending annular extension 48 at a forward end of a body portion 50 of the gun. The spray head assembly is for an air spray gun and comprises the air nozzle 28 and the fluid inlet fitting 32, together with a fluid nozzle 52, a fluid nozzle retainer 54 and an air cap 56. The inlet fitting and fluid nozzle have respective fluid passages 58 and 60 and are of a material which is corrosion and wear resistant to fluids conveyed through the passages, for example a material such as stainless steel or hardened steel.

The inlet fitting 32 is generally L-shaped and the annular extension 48 has a passage 62 therethrough which has a relatively small diameter at its inner end, increases in diameter toward its outer end and defines two tapered annular shoulders 64 and 66. One leg of the inlet fitting has external threads 68 and is extendable through the passage for connection with internal threads 70 in the fluid nozzle retainer 54, thereby to mount the inlet fitting and fluid nozzle retainer on the forward end of the gun body with the same extending into opposite ends of and compressibly gripping the annular extension therebetween. When the two elements are tightened together, tapered shoulders 72 and 74 on the fluid nozzle retainer abut and seal with the respective shoulders 64 and 66.

To connect the fluid nozzle 52 with the fluid nozzle retainer 54, the nozzle is extended into and threadably engaged with the retainer by means of respective threads 76 and 78 on the nozzle and retainer, until a seat 80 at an inner end of the nozzle moves against and seals with a seat 82 at the outer end of the inlet fitting passage 58. This mounts the inlet fitting, fluid nozzle retainer and fluid nozzle on the annular extension 48 and establishes a leakproof path through the fluid passages 58 and 60.

To complete the spray head assembly 46, the air nozzle 28 is moved over the outer end of the fluid nozzle 52 to extend an outer end 84 of the fluid nozzle into a passage 86 formed centrally through a front wall of the air nozzle and until a tapered shoulder 88 on the air nozzle engages and seats against a tapered shoulder 90 on the fluid nozzle. The air cap 56 is then placed around the air nozzle and threaded onto the fluid nozzle retainer 54 by means of internal threads 92 in the air cap and external threads 94 on the retainer, until a radially inwardly extending annular flange 96 at the outer end of the air cap engages a radially outwardly extending annular flange 98 on the air nozzle and moves the air nozzle tightly against the fluid nozzle to form a seal between the shoulders 88 and 90.

It may now be fully appreciated and understood that the entirety of the spray head assembly 46, i.e., the air nozzle 28, the inlet fitting 32, the fluid nozzle 52, the fluid nozzle retainer 54 and the air cap 56, is mounted on the annular extension 48 at the forward end of the spray gun body 50 without any threaded attachment to the body or extension. It is also to be appreciated that since all of the elements of the spray head assembly are separate and distinct, they may very conveniently be manufactured of any selected material and, if necessary, readily disassembled for individual repair or replacement without need to repair or replace the entirety of the spray head assembly.

Referring in particular to FIG. 2, to provide atomizing air to the spray head assembly 46, the gun body 50 has a passage 100 which receives air under pressure upon opening of the air valve means 34, and an air valve stem 102 extends through the passage to a seat 104 at a forward end thereof. The air valve stem is connected with the trigger 38 for being retracted when the gun is turned on, with the amount of retraction being determned by the setting of the air control knob 42, and when retracted establishes communication between the passage 100 and an annular passage 106 defined in the body extension 48 which communicates both with pattern forming air outlet orifices 108 in opposed ears of the air nozzle 28 and with an annular atomizing air outlet orifice 110 defined between the end 84 of the fluid nozzle 52 and the walls of the air nozzle passage 86. To establish a path between the passage 106 and the orifices 108, passages 112 extend through the fluid nozzle retainer and passages 114 through the ears of the air nozzle, and to provide air to the orifice 110, passages 116 extend through the fluid nozzle. Thus, triggering the gun discharges air to atomize dispensed material into a spray and form the spray into a fan-shaped pattern.

To control dispensing of fluid or coating material, the fluid valve stem 36 extends through an opening 118 in the rearward end of the fluid inlet fitting 32 and thence through the fluid passages 58 and 60 to a tapered valve seat 120 in the fluid nozzle passage. The valve stem is sealed with the opening 118 by means of a packing gland 122 and a compression fitting 124, and a forward end of the stem is provided with a taper 126 for movement against the valve seat. The rearward end of the valve stem is connected with the trigger 38, whereby operation of the trigger to turn on the gun retracts the stem from the valve seat for dispensing fluid from an outlet orifice 128 in the end 84 of the fluid nozzle 52, whereupon the fluid is atomized and formed into a fan-shaped pattern.

Figure 4:
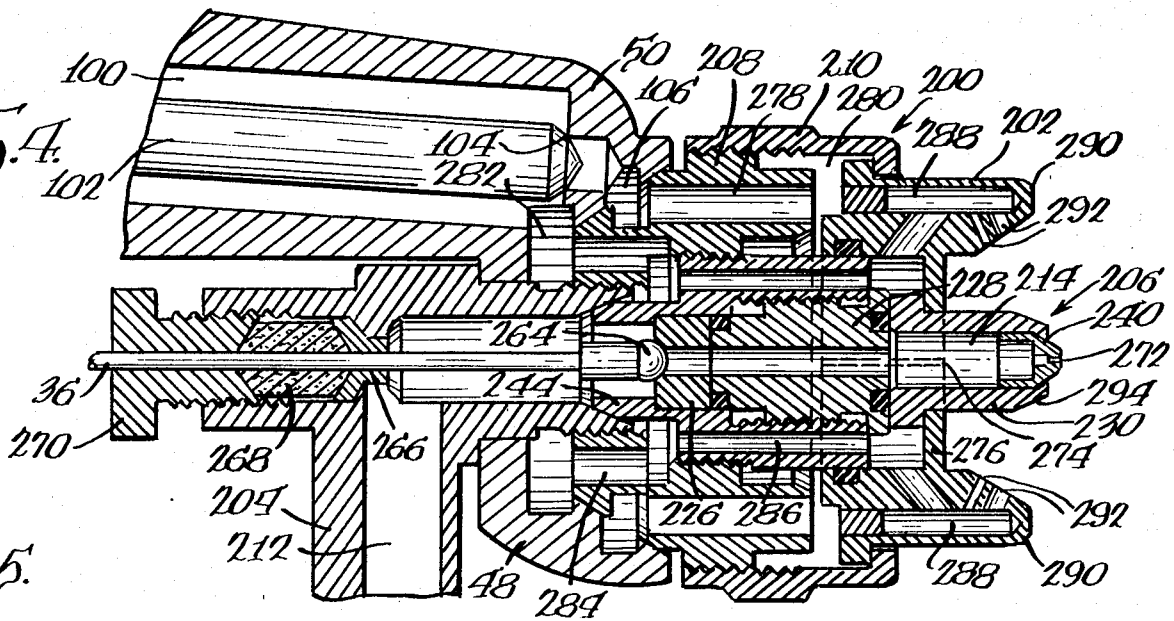
FIG. 4 is a cross sectional view of a spray head assembly in accordance with another embodiment of the invention.
Figure 5:
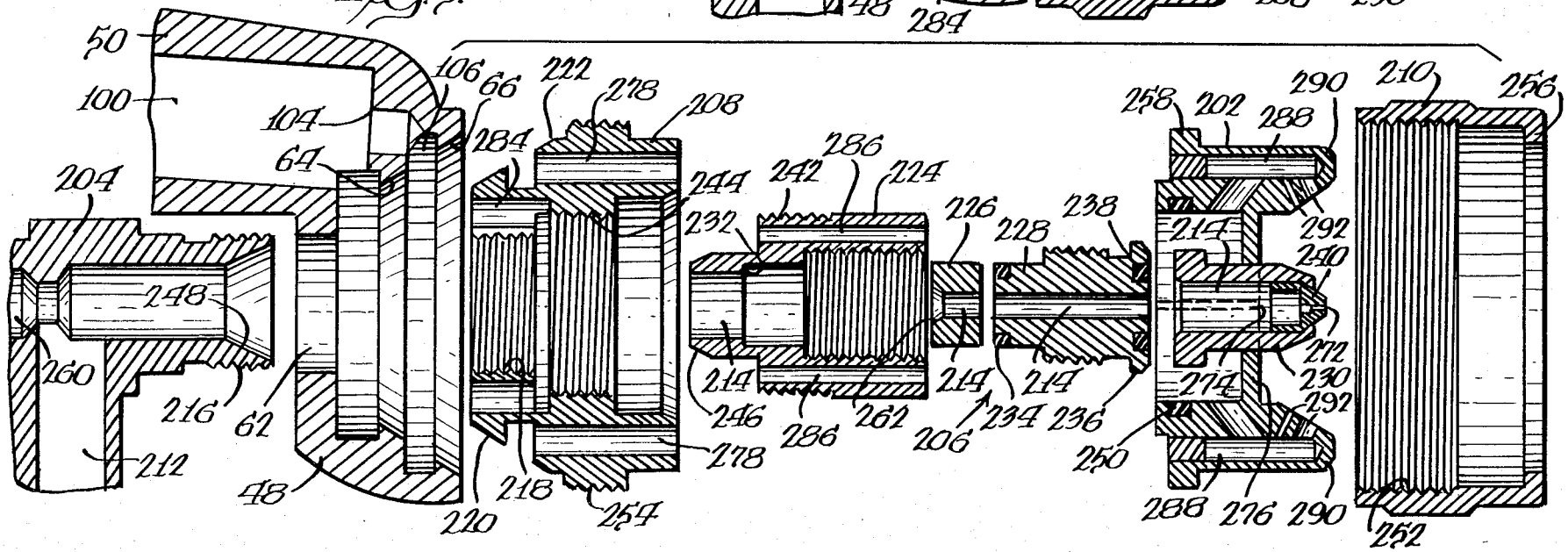
FIG. 5 is a cross sectional assembly view of the spray head assembly of FIG. 4.

The improved spray head assembly 46 as above described is for an air spray gun, in which a generally cylindrical stream of coating material emitted from the orifice 128 is atomized and formed into a fan-shaped spray solely by use of air. However, the improvements and advantages of the invention may also be obtained in a spray head assembly for a pneumatically assisted hydraulic spray gun, in which coating liquid under relatively high pressure is delivered to a specially shaped orifice for being emitted therefrom as a fan-shaped liquid film which atomizes into a spray at its forward edge and in which air is flowed against opposite sides of the film to improve the quality of atomization. Such an "air assisted airless" spray head assembly is shown in FIGS. 4 and 5 and indicated generally at 200, and is mounted on the downwardly depending annular extension 48 at the forward end of the body 50 of the spray gun. The spray head assembly comprises an air nozzle 202, a fluid inlet fitting 204, a fluid nozzle assembly indicated generally at 206, a fluid nozzle retainer 208 and an air cap 210. The inlet fitting and fluid nozzle assembly define respective fluid passages 212 and 214 therethrough, and are advantageously of a material which is corrosion and wear resistant to fluids conveyed through the passages, for example a material such as stainless steel or hardened steel.

The inlet fitting 204 is generally L-shaped and one leg of the fitting, which has external threads 216, is extendable through the passage 62 in the annular extension 48 for connection with internal threads 218 in the fluid nozzle retainer 208, thereby to mount the inlet fitting and fluid nozzle retainer on the gun body 50 with the same extending into opposite ends of and compressibly gripping the annular extension therebetween. When the two elements are securely tightened together, tapered shoulders 220 and 222 on the fluid nozzle retainer abut and seal with respectively ones of the tapered shoulders 64 and 66 in the extension.

The fluid nozzle assembly 206 comprises a fluid nozzle body 224, a seat 226, a seat retainer 228 and a fluid nozzle holder 230. The seat is placed in the passage through the fluid nozzle body to abut a shoulder 232 in the passage, and the seat retainer is then threaded into the fluid nozzle body into engagement with the seat, with an O-ring seal 234 at the rearward end of the seat retainer providing a fluid tight connection between the seat retainer and seat. A hex head 236 at the forward end of the seat retainer facilitates threading the same into the fluid nozzle body in tight abutting relationship against the seat, an O-ring seal 238 at the forward end of the seat retainer forms a fluid tight connection with an annular flange at the rearward end of the fluid nozzle holder when the same are brought together with a fluid nozzle or airless spray tip 240 is in the fluid nozzle holder at the forward end thereof.

To connect the fluid nozzle assembly 206 with the fluid nozzle retainer 208, the assembly is threaded into the retainer by means of respective threads 242 and 244 on the fluid nozzle body 224 and retainer until a seat 246 at an inner end of the fluid nozzle body moves against and seals with a seat 248 at the outer end of the inlet fitting passage 212. This mounts the inlet fitting, fluid nozzle retainer and fluid nozzle assembly on the annular gun body extension 48 and establishes a leakproof path through the fluid passage 212 and 214.

To complete the spray head assembly 200, the fluid nozzle holder 230 is extended through an axial opening in a front wall of the air nozzle 202 and the air nozzle is moved over the outer end of the fluid nozzle body 224 until the inner end of the fluid nozzle holder abuts the forward end of the seat retainer 228, at which point an O-ring seal 250 carried by the air nozzle forms a seal between the air nozzle and the outer surface of the fluid nozzle body. The air cap 210 is then placed around the air nozzle and threaded onto the fluid nozzle retainer 2008 by means of internal threads 252 in the air cap and external threads 254 on the retainer until a radially inwardly extending annular flange 256 at the outer end of the air cap engages a radially outwardly extending annular flange 258 on the air nozzle and moves the air nozzle tightly against the fluid nozzle holder to form a seal between the fluid nozzle holder and seat retainer.

It may now be appreciated that the entirety of the spray head assembly 200, i.e., the air nozzle 202, fluid inlet fitting 204, fluid nozzle assembly 206, fluid nozzle retainer 208 and air cap 210, is mounted on the annular extension 48 at the forward end of the spray gun body 50 without any threaded attached to the body or extension. It is also appreciated that since all of the elements of the spray head assembly are separate and distinct, they may conveniently be manufactured of any selected material and, if necessary, readily disassembled for individual repair or replacement without need to repair or replace the entirety of the spray head assembly.

To control dispensing of fluid or coating material, the fluid valve stem 36 extends through an opening 260 in the rearward end of the fluid inlet fitting 204 and thence through the passages 212 and 214 to a valve seat 262 in the rearward end of the passage through the seat 226. The stem carries a ball 264 at its forward end for opening and closing the passage through the seat, and is sealed with the opening 260 by means of a packing gland 266, packing 268 and a material packing screw 270. The rearward end of the valve stem is connected with the trigger 38, whereby operation of the trigger to turn on the gun retracts the ball from the valve seat for dispensing fluid from the fluid nozzle 240. The fluid is usually supplied at hydraulic pressures on the order of 400–1500 psi, and an orifice 272 formed through the fluid nozzle is specially shaped to convert fluid at such pressures into a fan-shaped planar film which atomizes into a fan-shaped spray at its foward edge.

To improve the quality of atomization and provide a means for controlling the angle of divergence of the fan-shaped spray, means are provided for causing air to flow against opposite planar surfaces of the film of material emitted from the orifice 272 as well as against opposite marginal side edges of the atomized spray. To provide air to opposite marginal side edges of the atomized spray, the gun body 50 has the air passage 100 which receives air under pressure upon opening of the air valve means 34, and the air valve stem 102 extends through the passage to against the seat 104 at the forward end thereof. The air valve stem is connected with the trigger 38 for being retracted when the gun is turned on, with the amount of retraction being determined by the setting of the air control knob 42, and when retracted establishes communication between the passage 100 and the annular passage 106 defined in the body extension 48, which latter passage communicates with a pair of air outlet orifices 274 (only one of which is shown) formed through a front wall 276 of the air nozzle 202 on opposite sides of the fluid nozzle holder 230. The orifices are positioned so that they direct jets of air against opposite side edges of the fan-shaped spray after its point of atomization, and to establish a path between the passage 106 and orifices 274 a plurality of passages 278 extend through the fluid nozzle retainer 208 between the passage 106 and a gap 280 between the fluid nozzle retainer and air nozzle 202 and around the fluid nozzle assembly 206, which gap communicates with the air outlet orifices 274. Thus, when the gun is triggered on, air from the orifices 274 is impinged against opposite side edges of the atomized spray to control the angle of divergence thereof, with the amount of air flow and therefore the angle of divergence being determined by the amount of retraction of the air valve stem is controlled by adjustment of the air control knob.

To provide jets of air for flow against opposite planar surfaces of the fan-shaped film of fluid emitted from the orifice 272, an annular passage 282 defined in the gun body extension 48 rearwardly of the fluid nozzle retainer 208 communicates through passages 284 in the fluid nozzle retainer and passages 286 in the fluid nozzle body 224 with passages 288 in ears 290 of the air nozzle 202. Air outlet orifices 292 in the ears communicate with the passages 288 and are directed toward an outer tapered surface 294 on the fluid nozzle holder 230. Consequently, the orifices impinge air against the tapered surface, which surface deflects the air for flow toward opposite planar surfaces of the fan-shaped fluid film.

Unlike for the marginal side air jets, no control over the flow rate of air through the orifices 292 is afforded by the air valve stem 102, since the annular passage 282 always communicates with the gun body passage 100. Instead, the flow rate is controlled by the setting of an air pressure regulator (not shown) through which air is supplied to the gun inlet fitting 26. The advantage of the arrangement is that for a given fluid orifice 272 and fluid to be sprayed, once a flow rate of air through the orifices 292 is established for the particular improvements in atomization desired, the flow rate ordinarily should not be changed, and by effecting control over the flow rate at a point remote from the gun it is unlikely that it will be accidentally changed. However, when ware of different configurations are spray coated, for efficiency in coating it is desirable to be able to vary the shape or angle of divergence of the fan-shaped spray, and that may conveniently be accomplished at the spray gun itself by means of the air control knob 42 without varying the flow rate of air through the orifices 292.

The invention thus provides improved spray guns having spray head assemblies formed of discrete components for ease in manufacture, assembly and replacement or repair of the same. The entirety of the spray head assembly, including the air cap for the air nozzle, is connected with the forward end of the gun body without need for any threaded connections with the body, whereby there are no threads on the gun body which may be damaged by the assembly, and the arrangement of the components of the assembly is such as to provide an improved "feel" of the gun to an operator.

While embodiments of the invention have been described in detail, various modifications and other embodiments thereof may be devised by one skilled in the art without departing from the spirit and scope of the invention, as defined in the appended claims.

What is claimed is:

1. A spray gun having a gun body and a spray head assembly carried at a forward end of said body for emitting an atomized spray of fluid, said spray head assembly comprising a fluid inlet fitting separate from said gun body and having a passage therethrough connectable at one end with a supply of fluid; a fluid nozzle having a passage therethrough terminating at one end in a fuid outlet orifice; a fluid nozzle retainer detachably connected with said fluid inlet fitting and said fluid nozzle for supporting the same with opposite ends of said passage in communication, whereby fluid introduced into said one end of said inlet fitting passage flows through said passages for being emitted from said orifice; air emitting means at said one end of said fluid nozzle for emitting air for flow against fluid emitted from said outlet orifice, said air emitting means being detachably connected with said fluid nozzle retainer; and a member integral with and extending from said forward end of said gun body, said inlet fitting and fluid nozzle retainer compressibly capturing said member therebetween without threaded connection therewith when the same are detachably connected to mount said spray head assembly on said member at said forward end of said gun body.

2. A spray gun as in claim 1, wherein said member comprises a downwardly depending annular member at said forward end of said gun body and having a passage therethrough, said inlet fitting and fluid nozzle retainer when detachably connected extending into opposite ends of said member passage and compressibly gripping said member therebetween.

3. A spray gun as in claim 1, wherein said air emitting means comprises an air nozzle at a forward end of said fluid nozzle and having a passage formed centrally therethrough for receiving therein said fluid outlet orifice, said air nozzle having at least one air outlet orifice for emitting air therefrom, and an air cap extended around said air nozzle and detachably connected with said fluid nozzle retainer for mounting said air nozzle on said fluid nozzle, said gun body having a passage therethrough accommodating supply of air under pressure to said air outlet orifice.

4. A spray gun as in claim 3, including threads on said fluid inlet fitting, said fluid nozzle, said fluid nozzle retainer and said air cap for accommodating detachable interconnection of the same.

5. A spray gun as in claim 3, wherein said fluid inlet fitting and said fluid member are of a material which is corrosion and wear resistant to fluid flowing through said passage thereof.

6. A spray gun as in claim 3, wherein said fluid outlet orifice is for emitting a stream of fluid and said at least one air nozzle orifice comprises an annular air outlet orifice around said fluid outlet orifice for emitting air for atomizing the fluid stream and air outlet orifices to opposite sides of said fluid outlet orifice for emitting air to form the atomized fluid into a generally fan-shaped spray.

7. A spray gun as in claim 3, wherein said fluid outlet orifice is shaped to emit a generally planar, fan-shaped fluid film which atomizes into a spray at its forward edge, and said at least one air outlet orifice of said air nozzle comprises a plurality of air outlet orifices for emitting air for flow toward opposite planar surfaces of the fan-shaped fluid film.

8. A spray gun as in claim 7, wherein said plurality of air outlet orifices include air outlet orifices for impinging air against opposite side edges of the atomized fan-shaped spray to control the angle of divergence thereof.

9. A spray gun as in claim 1, wherein said fluid nozzle comprises a fluid nozzle body detachably connected with said fluid nozzle retainer and having a passage therethrough; a seat in said fluid nozzle body passage, said seat having a passage therethrough and a valve seat at an inner end thereof; a seat retainer in said fluid nozzle body passage and retaining said seat therein, said seat retainer having a passage therethrough; and a fluid nozzle holder coupled with said seat retainer and having a passage therethrough and said fluid outlet orifice therein, said passages in all of said fluid nozzle body, seat, seat retainer and fluid nozzle holder being in communication and defining said fluid nozzle passage, and further including a valve movable away from and against said valve seat to establish and interrupt a path for a flow of fluid through said fluid nozzle passage.

10. A spray gun as in claim 9, wherein said fluid outlet orifice is shaped to emit a generally planar, fan-shaped fluid film which atomizes into a spray at its forward edge.

11. A spray gun hving a gun body and a spray head assembly carried at a foward end of said body for emitting therefrom an atomized spray of fluid, said body having a downwardly depending generally annular extension at said forward end and said spray head assembly comprising a fluid inlet fitting separate from said body and having a passage therethrough connectable at one end with a supply of fluid, a portion of said inlet fitting including an opposite end of said passage extending forwardly into said annular extension; a fluid nozzle retainer, a portion of said fluid nozzle retainer extending rearwardly into said annular extension into detachable threaded connection with said inlet fitting portion, said inlet fitting and said fluid nozzle retainer compressibly capturing said annular extension therebetween without threaded connection therewith, whereby said annular extension mounts the same on said forward end of said gun body; a fluid nozzle having a passage therethrough terminating at a forward end in a fluid outlet orifice, said fluid nozzle being detachably threadably connected with said fluid nozzle retainer with a rearward end of said fluid nozzle passage in communication with said opposite end of said inlet fitting passage, so that a path is established for a flow of fluid from said one end of said inlet fitting passage to and through said fluid nozzle outlet orifice; and air emitting means at said forward end of said fluid nozzle for emitting air for flow against fluid emitted from said outlet orifice.

12. A spray gun as in claim 11, wherein said air emitting means comprises an air nozzle carried on said fluid nozzle, said air nozzle having at least one air outlet orifice for emitting air for flow against fluid emitted from said fluid outlet orifice, and an air cap extended around said air nozzle into detachable threaded connection with said fluid nozzle retainer to mount said air nozzle on said fluid nozzle, whereby said spray head assembly is carried on said annular extension at said gun body forward end without any threaded connection with said body.

13. A spray gun as in claim 11, wherein said fluid inlet fitting and said fluid nozzle are of a material which is corrosion and wear resistant to fluid flowing through said passages thereof.

14. A spray gun as in claim 12, wherein said fluid outlet orifice is for emitting a stream of fluid and said at least one air nozzle outlet orifice includes a plurality of air outlet orifices for emitting air for atomizing said stream of fluid and for shaping the atomized fluid into a generally fan-shaped spray.

15. A spray gun as in claim 12, wherein said fluid outlet orifice is shaped to emit a generally planar fan-shaped fluid film which atomizes into a spray at its forward edge, and said at least one air nozzle outlet orifice comprises a plurality of air outlet orifices for emitting air for flow toward opposite planar surfaces of the fan-shaped fluid film.

16. A spray gun as in claim 15, wherein said plurality of air nozzle outlet orifices also impinge air against opposite side edges of the atomized fan-shaped spray to control the angle of divergence thereof.

17. A spray gun as in claim 11, wherein said fluid nozzle comprises a fluid nozzle body detachably threadably connected with said fluid nozzle retainer; valve seat means carried by said fluid nozzle body; valve seat retainer means detachably threadably connected with said fluid nozzle body and securing said valve seat means thereto; and a fluid nozzle holder having said fluid outlet orifice therein, all of said fluid nozzle body, valve seat means, valve seat retainer and fluid nozzle holder having passages therethrough establishing said fluid nozzle passage, and further including valve means movable away from and against said valve seat means to establish and interrupt said path for the flow of fluid to said fluid outlet orifice.

18. A spray gun as in claim 17, wherein said fluid outlet orifice is shaped to emit a generally planar, fan-shaped liquid film which atomizes into a spray at its forward edge.

19. A spray gun as in claim 17, wherein said air emitting means comprises an air nozzle carried on said fluid nozzle body, said fluid nozzle holder and fluid outlet orifice extending forwardly through said air nozzle, and an air cap extended around said air nozzle into detachable threaded connection with said fluid nozzle retainer to mount said air nozzle on said fluid nozzle body, whereby said spray head assembly is carried on said annular extension at said gun body forward end without any threaded connection with said body.

* * * * *